US006050893A

United States Patent [19]

Waite

[11] Patent Number: 6,050,893

[45] Date of Patent: Apr. 18, 2000

[54] COVER FOR AN ATTIC FAN VENT

[76] Inventor: Daniel R. Waite, 30 Santa Fe, Leavenworth, Kans. 66048

[21] Appl. No.: 09/176,600

[22] Filed: Oct. 21, 1998

[51] Int. Cl.[7] ..... F24F 13/20

[52] U.S. Cl. ..... 454/349; 49/463; 454/358

[58] Field of Search ..... 49/463, 464, 465, 49/466; 454/201, 254, 259, 339, 341, 347, 349, 350, 353, 354, 358, 359

[56] References Cited

U.S. PATENT DOCUMENTS

| | | | |
|---|---|---|---|
| 2,352,727 | 7/1944 | McMahon . | |
| 2,596,710 | 5/1952 | Moricco et al. | 49/463 X |
| 2,800,853 | 7/1957 | Spear . | |
| 3,590,237 | 6/1971 | Winters et al. | 49/465 |
| 4,287,815 | 9/1981 | Henderson | 49/463 X |
| 4,372,196 | 2/1983 | Henderson . | |
| 4,483,102 | 11/1984 | Edwards | 49/465 |
| 4,501,389 | 2/1985 | Kolt . | |
| 4,709,624 | 12/1987 | Croft . | |
| 4,760,773 | 8/1988 | Pezzulli . | |
| 5,123,876 | 6/1992 | McCullough . | |
| 5,213,543 | 5/1993 | Clariino | 454/284 X |

*Primary Examiner*—Harold Joyce
*Attorney, Agent, or Firm*—Kenneth L Tolar

[57] ABSTRACT

An insulating cover for overlaying a ceiling vent beneath an attic fan includes a substantially rectangular frame member having top and bottom edges. Horizontally disposed between the top and bottom edges are a plurality of panels including an intermediate insulating layer for minimizing air flow through the vent. A plurality of spring biased retractable fingers are mounted to the vent border which may be selectively extended to retain the cover therewithin.

8 Claims, 1 Drawing Sheet

COVER FOR AN ATTIC FAN VENT

BACKGROUND OF THE INVENTION

The present invention relates to a cover for a ceiling vent immediately beneath an attic fan to prevent cold air intrusion during winter months.

DESCRIPTION OF THE PRIOR ART

Attic fans are typically mounted immediately above a ceiling mounted vent for ventilating the attic during warmer months. During winter months, however, the vent, even if closed, provides a means for cold air intrusion from the attic. Accordingly, utility costs are increased significantly. The present invention relates to an insulated cover which may be quickly installed over the vent to minimize cold air intrusion during winter months.

Various covers and insulating devices exist in the prior art. For example, U.S. Pat. No. 5,123,876 issued to McCullough relates to an attic fan cover including a horizontal frame attachable to the ceiling below the attic fan opening having a cover panel slidably received therein. The frame further includes a switch actuated by the cover panel for activating the attic fan only when the panel is in a completely open position.

U.S. Pat. No. 4,760,773 issued to Pezzulli relates to a ventilator closure for mounting beneath a roof including a door which slides within a framework to selectively cover the ventilator opening in the roof.

U.S. Pat. No. 4,709,624 issued to Croft relates to an aperture seal for a roof mounted ventilator and a method for making same. The device comprises a base member having an insulating member coupled thereto. A cover member is coupled to the insulating member on a side opposite the base member.

U.S. Pat. No. 4,501,389 issued to Kolt relates to an automatic damper assembly.

U.S. Pat. No. 4,372,196 issued to Henderson relates to an insulating cover for the opening of an attic fan including a mounting frame engageable with the inner periphery of the opening. A pair of insulating panels are disposed within the frame and movable between open and closed positions in response to the cooling fan.

Although several covers for attic fan openings exist in the prior art, the conventional covers generally include framework permanently attached to the ceiling having panels movable thereon. Accordingly, the covers are not easily removable. Furthermore, the above described devices each include a myriad of components and are therefore more expensive and complicated to manufacture than the present invention.

SUMMARY OF THE INVENTION

The present invention relates to a cover for a ceiling mounted attic fan vent. The device comprises a substantially rectangular frame member having four vertical planar side walls, an upper edge and a lower edge. The upper and lower edges of the frame member each include an inwardly directed lip depending therefrom. On the top lip is a compressible strip for providing an air tight seal between the frame member and the vent border. Received within the frame member are a pair of horizontal rigid panels with an insulating layer disposed therebetween. Spring loaded retractable clips are mounted on the vent border for retaining the cover therein. It is therefore an object of the present invention to provide a cover for an attic fan opening that is easy to install.

It is yet another object of the present invention to provide a cover for an attic fan opening that minimizes air intrusion from the attic.

It is yet another object of the present invention to provide a cover for an attic fan opening that reduces energy loss associated with an attic fan. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
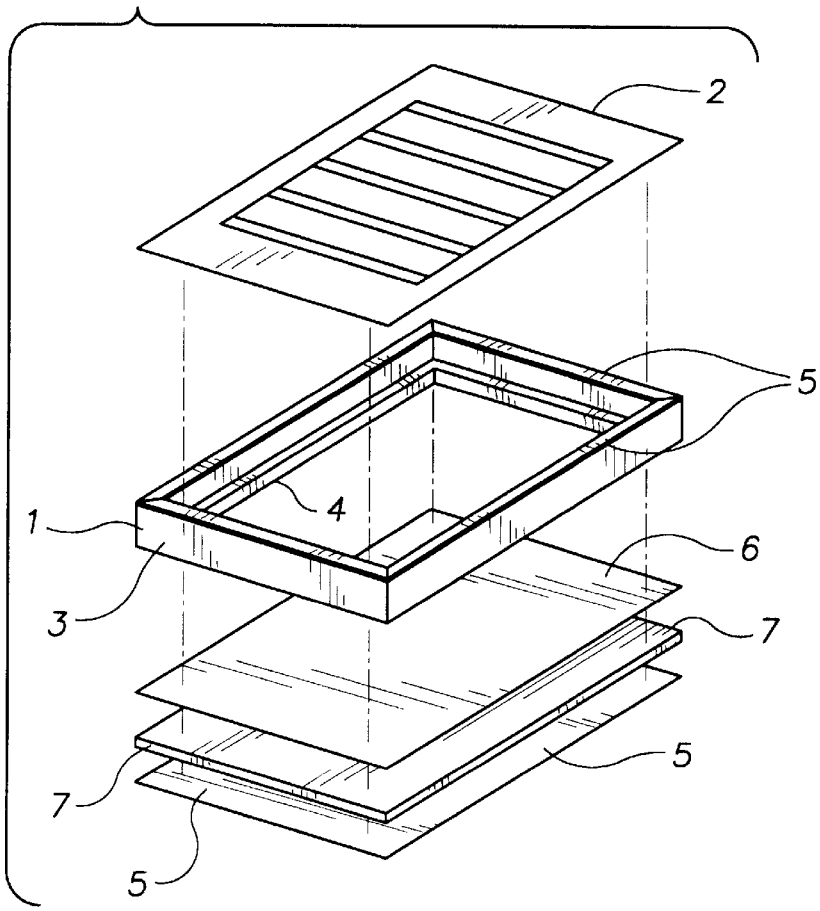
FIG. 1 is a partially exploded, perspective view of the inventive device.
Figure 2:
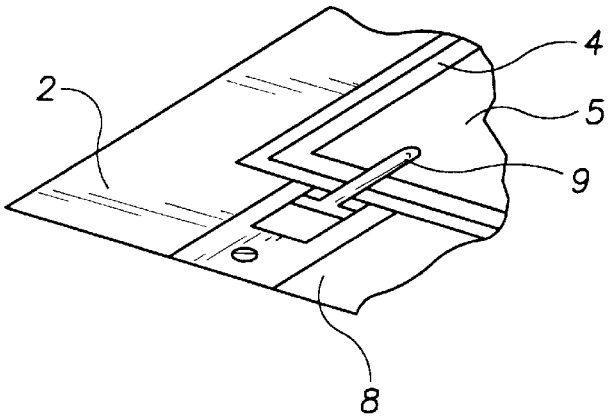
FIG. 2 is a partial, close-up view of the vent border with a spring biased retaining member attached thereto.

An attic fan is typically mounted immediately above a ceiling with a substantially rectangular opening therebeneath through which fresh air from the building interior is circulated into the attic. Covering the opening and mounted to the ceiling is a substantially rectangular vent including an outer border 2 and a plurality of pivotable louvers therebetween. The louvers are typically movable between an open, oblique position and a closed, flat position.

The present invention relates to a cover which may be secured to the vent when the louvers are in a closed position to prevent air leakage therethrough. The device comprises a substantially rectangular frame member 1 having four vertical planar side walls 3, a top edge and a bottom edge. The top edge and bottom edge each include an inwardly depending horizontal lip 4 for retaining a plurality of insulating panels therebetween. The top lip of the frame member includes a peripheral, continuous strip 5 for providing an air tight seal between the frame member and the vent.

The insulating panels preferably relate to first 5 and second 6 rigid panels with a flexible insulating layer 7 disposed therebetween. The insulating layer is preferably constructed with a heat resistant material such as foam, fiber glass or similar materials. The rigid panels and the interposed insulating layer are horizontally disposed within the frame members and are retained therein by the lips.

A plurality of retaining members 8 are mounted to the periphery of the vent border for retaining the cover immediately beneath the louvers. The retaining members each include spring biased fingers 9 that are selectively movable between an extended and retracted position. When the fingers are in an extended position, the lower edge of the frame member is supported on the upper surface of the fingers. In a retracted position, the fingers do not extend beyond the vent border allowing the frame member to be easily removed. Accordingly, the cover may be quickly and conveniently installed over the vent by placing the cover thereover. The fingers are then extended beneath the cover to retain the cover within the border and over the louvers.

The frame and rigid panels are preferably constructed with aluminum while the insulating layer and strip are manufactured with foam. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An insulating cover for use in a building having an opening in a ceiling and an attic fan thereabove with a vent mounted to the ceiling and covering said opening, said vent including a peripheral border and an air permeable portion therebetween, the cover comprising:

a substantially rectangular frame member having four side walls, each having a top edge and a bottom edge, said frame dimensioned to fit within said vent border;

at least one insulating cover panel horizontally received within said frame member, said panel having four edges, each of which is immediately adjacent a sidewall of the frame member to obstruct air flow through said vent;

a plurality of spring biased retractable fingers attached to the vent border, each of said fingers movable between an extended and retracted position.

2. A device according to claim 1 further comprising:

a horizontal lip inwardly extending from both the top and bottom edge of each side wall for retaining said cover panel within said frame member.

3. A device according to claim 2 wherein said cover panel is disposed between a pair of rigid panels to provide structural integrity to said cover panel.

4. A device according to claim 3 wherein said cover panel is constructed with a foam material.

5. A device according to claim 3 wherein said frame member further comprises a strip peripherally attached to the lip extending from the top edge of said frame member for providing an air tight seal between said frame member and said vent.

6. An insulating cover for use in a building having an opening in a ceiling with an attic fan thereabove and a vent mounted to the ceiling and covering said opening, said vent including a peripheral border with an air permeable portion therebetween, the cover comprising:

a substantially rectangular frame member having four side walls, each having a top and a bottom edge;

first and second rigid panels having an interposed insulating layer, said panels horizontally received within and surrounded by said frame member;

a horizontal lip inwardly extending from the top and bottom edges of each side wall for retaining said panels and said insulating layer within said frame member;

means for securing said frame member to said vent, said means including a plurality of spring biased retractable fingers mounted to said vent border, said fingers movable between an extended position to rest beneath the lower edge of said frame member and a retracted position whereby said frame member may be removed from said vent.

7. A device according to claim 6 wherein said frame member includes a continuous, peripheral strip attached to the lip extending from the top edge of said frame member for providing an air tight seal between said frame member and said vent border.

8. An insulating cover for use in a building having an opening in a ceiling and an attic fan thereabove with a vent mounted to the ceiling and covering said opening, said vent including a peripheral border and an air permeable portion therebetween, the cover comprising:

a substantially rectangular frame member having four side walls, each having a top edge and a bottom edge, said frame dimensioned to fit within said vent border;

at least one insulating cover panel horizontally received within said frame member, said panel having four edges, each of which is immediately adjacent a sidewall of the frame member to obstruct air flow through said vent;

a plurality of fingers attached to the vent border, each of said fingers horizontally movable between extended and retracted position and biased into a position horizontally extending into said opening to retain said cover thereabove, said fingers horizontally retractable towards said vent border to release said cover.

* * * * *